US009136042B2

(12) United States Patent
Sugiyama et al.

(10) Patent No.: US 9,136,042 B2
(45) Date of Patent: Sep. 15, 2015

(54) DIFFERENTIAL SIGNAL TRANSMISSION CABLE, MULTIWIRE DIFFERENTIAL SIGNAL TRANSMISSION CABLE, AND DIFFERENTIAL SIGNAL TRANSMISSION CABLE PRODUCING METHOD AND APPARATUS

(71) Applicant: Hitachi Cable, Ltd., Tokyo (JP)

(72) Inventors: Takahiro Sugiyama, Hitachi (JP); Hideki Nonen, Hitachi (JP); Hiroaki Hayashi, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 191 days.

(21) Appl. No.: 13/782,979

(22) Filed: Mar. 1, 2013

(65) Prior Publication Data

US 2014/0034352 A1 Feb. 6, 2014

(30) Foreign Application Priority Data

Jul. 31, 2012 (JP) ..... 2012-169905

(51) Int. Cl.

*H01B 7/00* (2006.01)
*H01B 11/00* (2006.01)
*H01B 13/00* (2006.01)
(Continued)

(52) U.S. Cl.

CPC ..... *H01B 11/00* (2013.01); *H01B 11/1869* (2013.01); *H01B 13/00* (2013.01); *H01B 13/0841* (2013.01); *H01B 11/1826* (2013.01);

(Continued)

(58) Field of Classification Search

CPC ..... H01B 3/00; H01B 7/00; H01B 7/02; H01B 7/0018; H01B 7/0258; H01B 7/0216
USPC ..... 174/110 R, 113 R, 117 R, 117 F, 117 FF
See application file for complete search history.

(56) References Cited

U.S. PATENT DOCUMENTS 4,096,346 A * 6/1978 Stine et al. ..... 174/36
4,150,249 A * 4/1979 Pedersen ..... 174/36
(Continued)

FOREIGN PATENT DOCUMENTS

JP H 07-320571 A 12/1995
JP 2008-181755 A 8/2008
WO WO2006/031633 A1 * 3/2006 ..... H01B 11/06

OTHER PUBLICATIONS

Japanese Office Action dated Jun. 16, 2015 with English translation.

*Primary Examiner* — William H Mayo, III
(74) *Attorney, Agent, or Firm* — McGinn IP Law Group, PLLC

(57) ABSTRACT

A differential signal transmission cable includes an insulated wire including a pair of differential signal transmission conductors coated with an insulation, a shield tape conductor made of a band-like member including an electrically conductive metal layer, and wrapped along an outer surface of the insulated wire so that its ends in a width direction are overlapped together, a first resin tape spirally wound along an outer surface of the shield tape conductor and around an outer side of the shield tape conductor, and a second resin tape spirally wound along an outer surface of the first resin tape and around an outer side of the first resin tape. The shield tape conductor, the first resin tape and the second resin tape are wound in a same circumferential direction around a center axis of the insulated wire.

20 Claims, 10 Drawing Sheets

(51) Int. Cl.
*H01B 13/08* (2006.01)
*H01B 11/18* (2006.01)
*H01B 11/20* (2006.01)

(52) U.S. Cl.
CPC ..... *H01B 11/20* (2013.01); *Y10T 29/49117* (2015.01)

(56) References Cited

U.S. PATENT DOCUMENTS 4,327,246 A * 4/1982 Kincaid ..... 174/36
5,142,100 A * 8/1992 Vaupotic ..... 174/24
5,956,445 A * 9/1999 Deitz et al. ..... 385/100
6,010,788 A * 1/2000 Kebabjian et al. ..... 428/381
6,255,594 B1 * 7/2001 Hudson ..... 174/121 A
6,403,887 B1 * 6/2002 Kebabjian et al. ..... 174/110 R
6,566,606 B1 * 5/2003 Hazy et al. ..... 174/113 R
6,677,534 B2 * 1/2004 Yamamoto et al. ..... 174/113 R
6,740,808 B1 * 5/2004 Chang ..... 174/36
7,790,981 B2 * 9/2010 Vaupotic et al. ..... 174/36
8,575,488 B2 11/2013 Sugiyama et al.
8,704,088 B2 * 4/2014 Frey ..... 174/36
2012/0186850 A1 7/2012 Sugiyama et al.

* cited by examiner

DIFFERENTIAL SIGNAL TRANSMISSION CABLE, MULTIWIRE DIFFERENTIAL SIGNAL TRANSMISSION CABLE, AND DIFFERENTIAL SIGNAL TRANSMISSION CABLE PRODUCING METHOD AND APPARATUS

The present application is based on Japanese patent application No. 2012-169905 filed on Jul. 31, 2012, the entire contents of which are incorporated herein by reference.

BACKGROUND OF THE INVENTION

1. Field of the Invention

This invention relates to a differential signal transmission cable, a multiwire differential signal transmission cable, a differential signal transmission cable producing method and apparatus.

2. Description of the Related Art

Conventionally, differential signal transmission cables with a pair of differential signal transmission conductors coated with an insulation have been known. Some differential signal transmission cables of this type are wrapped with an electrically conductive shield tape around an insulation. (Refer to U.S. Pat. No. 7,790,981, for example.)

The differential signal transmission cable disclosed by U.S. Pat. No. 7,790,981 has a pair of conductors coated with an insulation, and this insulation is wrapped with the shield tape therearound. Two tapes are spirally wound around the shield tape, and the two tapes are made of a polymer to hold the shield tape. The two tapes are wound so that circumferential spiral winding directions of the two tapes around a center axis of the shield tape are opposite each other.

Refer to U.S. Pat. No. 7,790,981, for example.

SUMMARY OF THE INVENTION

In the differential signal transmission cable thus configured, the occurrence of an unintended gap between the insulation and the shield tape causes a skew that is a signal propagation delay time difference between the pair of conductors, or rapid signal attenuation in a high frequency band (e.g. 10 Gbps or higher). No signal can normally be received in a receiving side. When the shield tape is longitudinally wrapped in such a manner that both ends in a width direction of the shield tape are overlapped together, a skew or rapid signal attenuation may also occur due to property variation caused by the occurrence of a gap in the overlapped portions between both the ends.

The inventors have found out that when the tapes are doubly wound around the shield tape, a gap is likely to occur between the insulation and the shield tape and/or in the overlapped portions of the shield tape, and have found that the occurrence of the gap can be suppressed by suppressing pivots of the conductors, the insulation, and the shield tape when the tapes are doubly wound therearound.

The present invention is based on this finding, and it is an object of the present invention to provide a differential signal transmission cable, a multiwire differential signal transmission cable, a differential signal transmission cable producing method, and a differential signal transmission cable producing apparatus that are capable of suppressing the occurrence of a gap between an insulation, which coats a pair of differential signal transmission conductors, and a shield tape conductor, and the occurrence of a gap in overlapped portions of the longitudinally wrapped shield tape conductor.

(1) According to a first feature of the invention, a differential signal transmission cable comprises:

an insulated wire comprising a pair of differential signal transmission conductors coated with an insulation;

a shield tape conductor made of a band-like member including an electrically conductive metal layer, the shield tape conductor wrapped along an outer surface of the insulated wire so that ends in a width direction of the shield tape conductor are overlapped together;

a first resin tape spirally wound along an outer surface of the shield tape conductor and around an outer side of the shield tape conductor; and a second resin tape spirally wound along an outer surface of the first resin tape and around an outer side of the first resin tape, in which the shield tape conductor, the first resin tape and the second resin tape are wound in a same circumferential direction around a center axis of the insulated wire.

In the first feature, the following modifications and changes can be made.

(i) The differential signal transmission cable may further comprise adhesive layers provided around the outer side of the first resin tape and an inner side of the second resin tape respectively, in which the first resin tape and the second resin tape are joined together by the adhesive layers.

(ii) The first resin tape may be wrapped so that its portions in a width direction are overlapped together, the second resin tape may be wrapped so that its overlapped portions are shifted in a center axis direction of the insulated wire relative to the overlapped portions by wrapping of the first resin tape, (iii) The pair of differential signal transmission conductors in the insulated wire may be together coated with the insulation, and the insulation may comprise a convex and continuous outer shape in cross section perpendicular to a longitudinal direction of the insulated wire.

(2) According to a second feature of the invention, a multiwire differential signal transmission cable comprises a plurality of the differential signal transmission cables specified in (1) above, the plurality of the differential signal transmission cables being shielded together, (3) According to a third feature of the invention, a differential signal transmission cable producing method comprises:

wrapping a shield tape conductor made of a band-like member including an electrically conductive metal layer around an outer side of an insulated wire comprising a pair of differential signal transmission conductors coated with an insulation, in such a manner that both ends of the shield tape conductor in a width direction are overlapped together;

spirally winding a first resin tape along an outer surface of the shield tape conductor and around an outer side of the shield tape conductor; and spirally winding a second resin tape along an outer surface of the first resin tape and around an outer side of the first resin tape, in which circumferential winding directions around a center axis of the insulated wire of the shield tape conductor, the first resin tape and the second resin tape are the same.

In the third feature, the following modifications and changes can be made.

(i) The first resin tape and the second resin tape may be spirally wound in such a manner that a displacement of the insulated wire due to a tension when the first resin tape is spirally wound is always suppressed by a tension when the second resin tape is spirally wound.

(ii) The first resin tape and the second resin tape may be spirally wound by inserting the insulated wire in a through hole provided in a ring member, guiding the first resin tape and the second resin tape with first and second guiding portions respectively fixed to the ring member, and rotating the ring member, in which the first and second guiding portions are fixed to locate the insulated wire therebetween.

(4) According to a fourth feature of the invention, a differential signal transmission cable producing apparatus for use in production of the differential signal transmission cable specified in (1) comprises:

means for tensioning and moving the insulated wire in a longitudinal direction of the insulated wire;

means for longitudinally wrapping the shield tape conductor in the longitudinal direction of the insulated wire; and means for spirally winding the first resin tape and the second resin tape in the same direction, in which the spirally winding means includes: a ring member provided with a through hole in a central portion for the insulated wire to be inserted therein; a first supporting portion for supporting a first reel wound with the first resin tape; a second supporting portion for pivotably supporting a second reel wound with the second resin tape; and a rotary drive mechanism for rotating the ring member around the insulated wire together with the first supporting portion and the second supporting portion.

In the fourth feature, the following modifications and changes can be made.

The spirally winding means further includes: a first guiding member for guiding the first resin tape to an outer side of the shield tape conductor; and a second guiding member for guiding the second resin tape to an outer side of the first resin tape, in which the first guiding member and the second guiding member are fixed to locate the insulated wire therebetween.

(Points of the Invention)

According to the invention, it is possible to suppress the occurrence of a gap between the insulation, which coats the pair of differential signal transmission conductors, and the shield tape conductor, and the occurrence of a gap in the overlapped portions of the longitudinally wrapped shield tape conductor.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Embodiment

Figure 1:
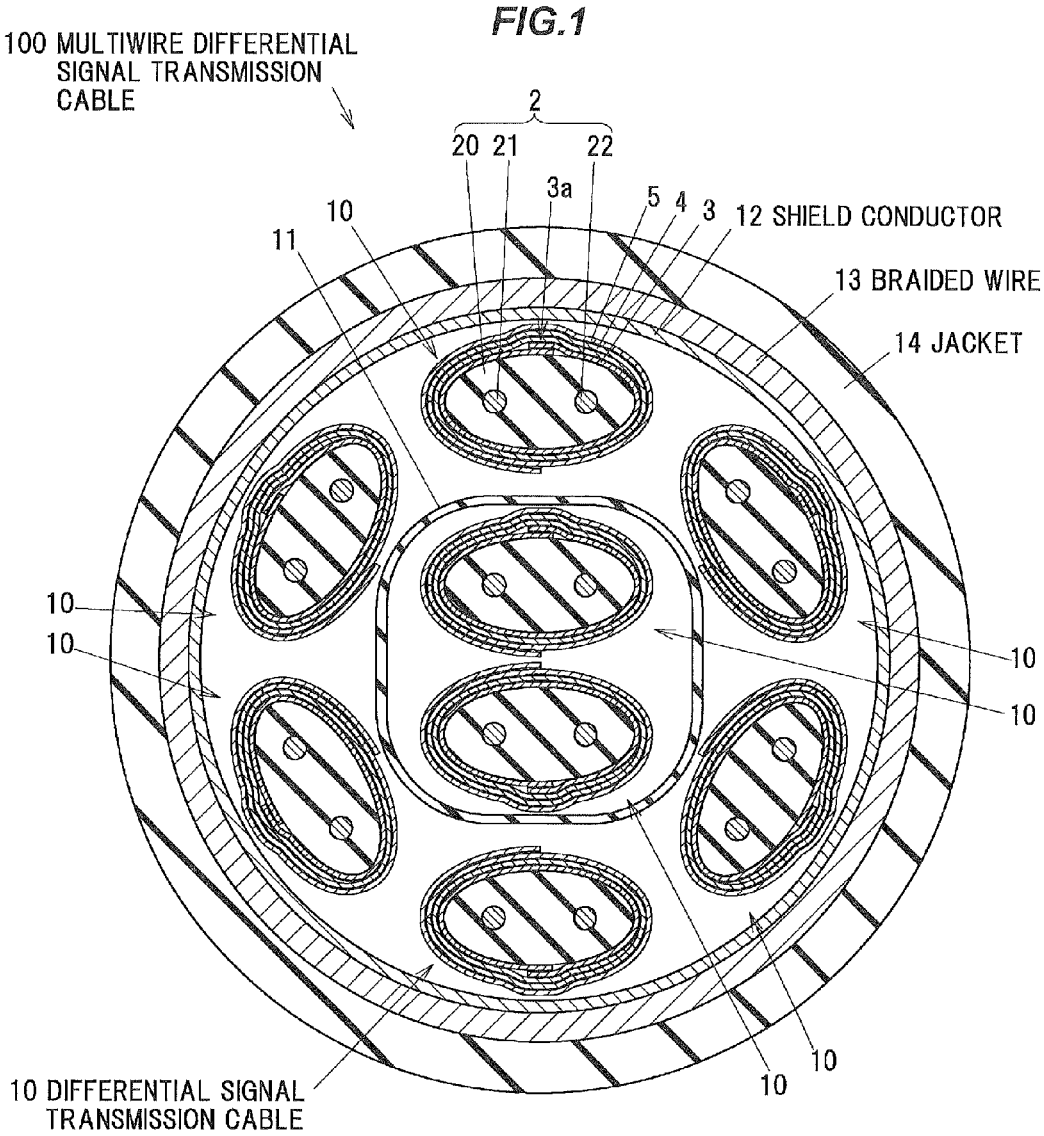
FIG. 1 is a cross-sectional view showing a cross-sectional structure of a multiwire differential signal transmission cable including a plurality of differential signal transmission cables in an embodiment according to the invention.

FIG. 1 is a cross-sectional view showing a cross-sectional structure of a multiwire differential signal transmission cable 100 including a plurality of differential signal transmission cables 10 in an embodiment according to the invention.

This multiwire differential signal transmission cable 100 is configured so that the plurality of differential signal transmission cables 10 (in the example shown in FIG. 1, eight differential signal transmission cables 10) are bundled together, and these bundled plural differential signal transmission cables 10 are shielded together with a shield conductor 12, and a perimeter of the shield conductor 12 is further covered with a braided wire 13, and these plural differential signal transmission cables 10, shield conductor 12 and braided wire 13 are received in a flexible jacket 14 made of an insulation.

Also, in the example shown in FIG. 1, two of the differential signal transmission cables 10 are disposed in a central portion of the multiwire differential signal transmission cable 100, and the two differential signal transmission cables 10 are received in a tubular inclusion 11 made of strands, a foamed polyolefin or the like. Also, the other six differential signal transmission cables 10 are substantially equally spaced apart around an outer side of the inclusion 11.

(Configuration of the Differential Signal Transmission Cable 10)

Figure 2:
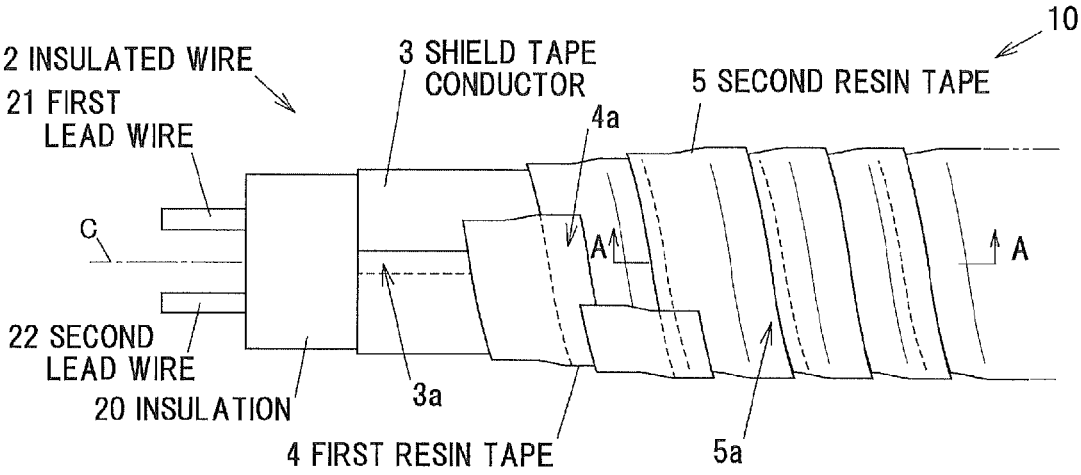
FIG. 2 is a side view showing a configuration of the differential signal transmission cable in this embodiment.

FIG. 2 is a side view showing a configuration of the differential signal transmission cable 10 in this embodiment.

The differential signal transmission cable 10 includes an insulated wire 2 comprising first and second differential signal transmission lead wires 21 and 22 coated with an insulation 20, a shield tape conductor 3 longitudinally wrapped along an outer surface of the insulated wire 2, a first resin tape 4 spirally wound along an outer surface of the shield tape conductor 3 and around an outer side of the shield tape conductor 3, and a second resin tape 5 spirally wound along an outer surface of the first resin tape 4 and around an outer side of the first resin tape 4.

In the insulated wire 2, the first lead wire 21 and the second lead wire 22 made of an electrically conductive metal such as copper or the like are disposed parallel to each other, and these first lead wire 21 and second lead wire 22 are together coated with the insulation 20. The insulation 20 has a convex and continuous outer shape in cross section perpendicular to a longitudinal direction of the insulated wire 2, and is shaped into an oval whose diameter in a first direction that is an alignment direction of the first lead wire 21 and the second lead wire 22 is greater than a diameter in a second direction perpendicular to the first direction. That is, the insulation 20 has the outer shape of an entire smooth continuous convex surface with no flat portion and hollow portion.

The insulation 20 has an elliptic outer edge in cross section perpendicular to the center axis of the insulated wire 2. As a material for the insulation 20, there can be used, for example a Teflon (registered trademark) based material such as polyethylene foam, foamed Teflon, tetrafluoroethylene-hexafluoropropylene copolymer (FEP), or the like.

The shield tape conductor 3 is made of a band-like member with an electrically conductive metal layer, and is wrapped along the outer surface of the insulation 20 in such a manner that its ends in a width direction are overlapped together. In FIG. 2, the overlapped portions of one end and the other end in the width direction of the shield tape conductor 3 are indicated by reference numeral 3*a*, and one end face in the width direction of the shield tape conductor 3 on the lower side (insulation 20 side) of the overlapped portions 3*a* is indicated by a broken line. The shield tape conductor 3 is longitudinally wrapped around the insulation 20 in such a manner that its longitudinal direction is parallel to the center axis direction of the insulated wire 2. That is, the overlapped portions 3*a* are extended parallel to the center axis of the insulated wire 2.

The first resin tape 4 is made of a band-like taping member made of a flexible resin, and is spirally wound so that its one end and the other end in a width direction are overlapped together. That is, the first resin tape 4 is wound so that the longitudinal direction of the first resin tape 4 is oblique to the overlapped portions 3*a*. In this embodiment, the first resin tape 4 is wrapped so that the dimensions of overlapped portions 4*a* in the width direction of the first resin tape 4 (the overlapped portions of one end and the other end in the width direction of the first resin tape 4) are one fourth to one half of the width dimension of the first resin tape 4.

As with the first resin tape 4, the second resin tape 5 is made of a band-like taping member made of a flexible resin, and is spirally wound so that its one end and the other end in a width direction are overlapped together. In this embodiment, the second resin tape 5 is wrapped so that the dimensions of overlapped portions 5*a* in the width direction of the second resin tape 5 (the overlapped portion of one end and the other end in the width direction of the second resin tape 5) are one fourth to one half of the width dimension of the second resin tape 5. Incidentally, in FIG. 2, for description, the first resin tape 4 and the second resin tape 5 are shown as being partially removed.

The shield tape conductor 3 and the first and second resin tapes 4 and 5 are wound in the same circumferential direction around the center axis of the insulated wire 2. That is, the first resin tape 4 is wound from one lower end face indicated by broken lines in FIG. 2 of the overlapped portions 3*a* of the shield tape conductor 3, toward the other upper end face thereof indicated by solid lines, and the second resin tape 5 is likewise wound in the same direction.

Figure 3:
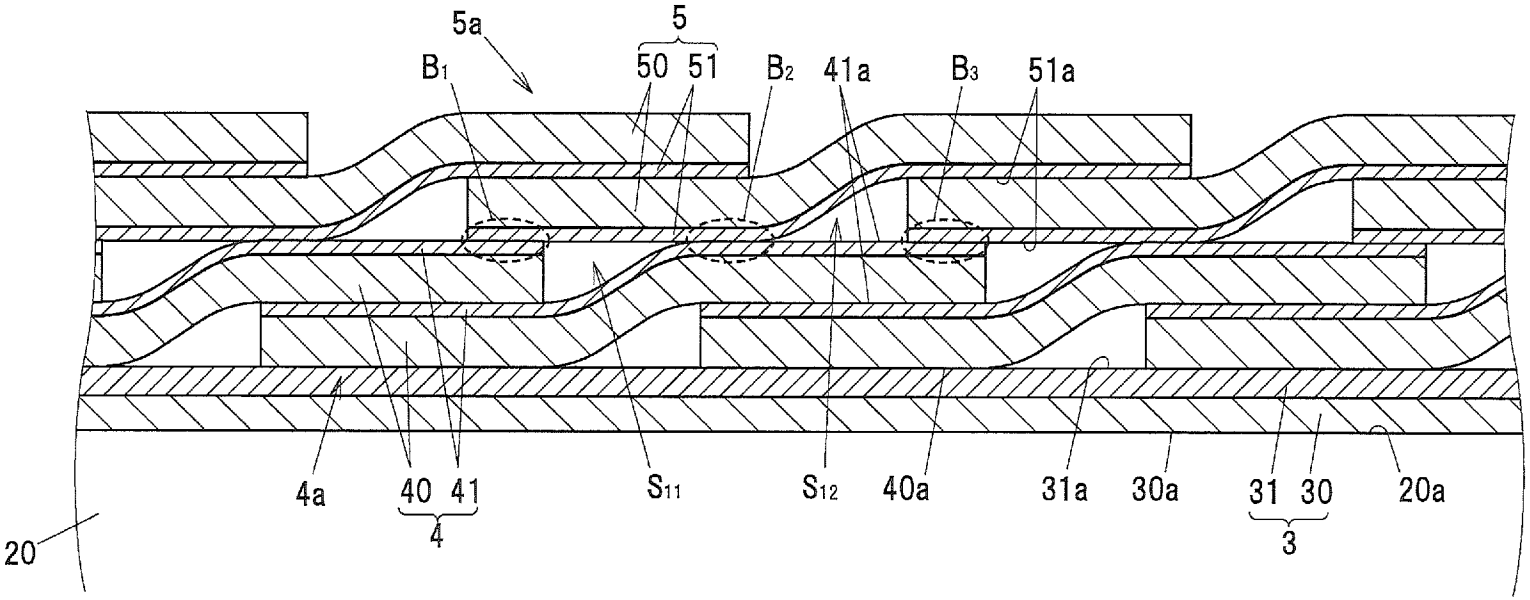
FIG. 3 is a partial cross-sectional view along line A-A in FIG. 2 showing the differential signal transmission cable.

FIG. 3 is a partial cross-sectional view along line A-A in FIG. 2 showing the differential signal transmission cable 10. Incidentally, in FIG. 2, for description, the thicknesses of the shield tape conductor 3, the first resin tape 4 and the second resin tape 5 are exaggeratedly represented.

The shield tape conductor 3 is configured in such a manner that for example, a resin layer 30 made of a flexible insulating resin such as PET (polyethylene terephthalate) or the like, and a metal layer 31 made of an electrically conductive metal such as copper, aluminum or the like to be provided over one surface of the resin layer 30 are stacked. The resin layer 30 is disposed on the insulated wire 2 side relative to the metal layer 31, and a surface 30*a* of the resin layer 30 is contacted with an outer surface 20*a* of the insulation 20. The thickness of the resin layer 30 is, for example, 10 to 15 μm, and the thickness of the metal layer 31 is e.g. 6 to 12 μm.

The first resin tape 4 is configured to include, for example, a resin layer 40 made of a flexible insulating resin such as PET or the like, and an adhesive layer 41 including an adhesive stacked and formed over the resin layer 40. The adhesive layer 41 is disposed around an outer side of the differential signal transmission cable 10 relative to the resin layer 40. A surface 40*a* of the resin layer 40 is contacted with a surface 31*a* of the metal layer 31 of the shield tape conductor 3. In the overlapped portions 4*a* of the first resin tape 4, the adhesive layer 41 around the lower side (the shield tape conductor 3 side) at one end of the first resin tape 4 joins together the resin layer 40 at that one end, and the resin layer 40 around the upper side (the second resin tape 5 side) at the other end of the first resin tape 4.

As with the first resin tape 4, the second resin tape 5 is configured to include e.g. a resin layer 50 made of a flexible insulating resin such as PET or the like, and an adhesive layer 51 including an adhesive stacked and formed over the resin layer 50. The adhesive layer 51 is disposed around an inner side of the differential signal transmission cable 10 relative to the resin layer 50. A surface 51*a* of the adhesive layer 51 is partially contacted with a surface 41*a* of the adhesive layer 41 of the first resin tape 4, to join the surface 51*a* and the surface 41*a* together. That is, the first resin tape 4 and the second resin tape 5 are joined together by the adhesive layers 41 and 51 provided around the outer side of the first resin tape 4 and the inner side of the second resin tape 5 respectively.

In the overlapped portions 5*a* of the second resin tape 5, the adhesive layer 51 around the upper side (the outer side of the differential signal transmission cable 10) at one end of the second resin tape 5 joins together the resin layer 50 at that one end, and the resin layer 50 around the lower side (the first resin tape 4 side) at the other end of the second resin tape 5.

In this embodiment, the width dimension and the thickness of the first resin tape 4 and the second resin tape 5 are the same. That is, the first resin tape 4 and the second resin tape 5 are configured according to the same specifications, except that the adhesive layers 41 and 51 are located opposite relative to the resin layers 40 and 50. The thicknesses of the resin layers 40 and 50 are e.g. 10 to 15 μm, and the thicknesses of the adhesive layers 41 and 51 are e.g. 2 to 5 μm.

As shown in FIG. 3, the second resin tape 5 is wrapped so that its overlapped portions 5*a* are shifted in the center axis C direction of the insulated wire 2 relative to the overlapped portions 4*a* by wrapping of the first resin tape 4. This joins the ends of the first resin tape 4 on the respective upper sides of the two adjacent overlapped portions 4*a* along the center axis C of the insulated wire 2 to the second resin tape 5 on the lower side of one overlapped portion 5*a*, in B1 portion and B2 portion shown in FIG. 3. Between the surface 41*a* of the adhesive layer 41 and the surface 51*a* of the adhesive layer 51 between the B1 portion and the B2 portion, there is formed a gap S11. This gap S11 is an air gap in which the adhesive layer 41 and the adhesive layer 51 are not joined together.

Also, the ends of the second resin tape 5 on the respective lower sides of the two adjacent overlapped portions 5*a* along the center axis C of the insulated wire 2 are joined to the first resin tape 4 on the upper side of one overlapped portion 4*a*, in B2 portion and B3 portion shown in FIG. 3. Between the surface 41*a* of the adhesive layer 41 and the surface 51*a* of the adhesive layer 51 between the B2 portion and the B3 portion, there is formed a gap S12. As with the gap S11, this gap S12 is an air gap in which the adhesive layer 41 and the adhesive layer 51 are not joined together.

The differential signal transmission cable 10 configured in the above manner transmits differential signals with the first and the second lead wires 21 and 22. That is, in communications using the differential signal transmission cable 10, the transmitting side outputs signals with mutually opposite phases to the first lead wire 21 and the second lead wire 22, while the receiving side receives (decodes) the signals transmitted based on a potential difference between the first lead wire 21 and the second lead wire 22. With this communications method, for example, when noise is superposed on the first lead wire 21, similar noise is superposed on the second lead wire 22. Therefore, effects on the signal potential difference in the receiving side are suppressed, and high noise resistant communications are possible.

It should be noted, however, that, in the event a gap opens between the outer surface 20*a* of the insulation 20 and the shield tape conductor 3, or a gap opens between one end and the other end in the width direction of the shield tape conductor 3 in the overlapped portions 3*a*, there arises a difference between a signal propagation delay time difference in the first lead wire 21 and a signal propagation delay time difference in the second lead wire 22, and no signal can normally be received in the receiving side, depending on the size of those gaps. In this embodiment, however, a producing method shown below suppresses the occurrence of the gap between the outer surface 20*a* of the insulation 20 and the shield tape conductor 3, and between one end and the other end in the width direction of the shield tape conductor 3 in the overlapped portions 3*a*.

(Differential Signal Transmission Cable 10 Producing Method and Apparatus)

A differential signal transmission cable 10 producing method and apparatus are described with reference to FIGS. 4A to 7D.

Figure 4A:
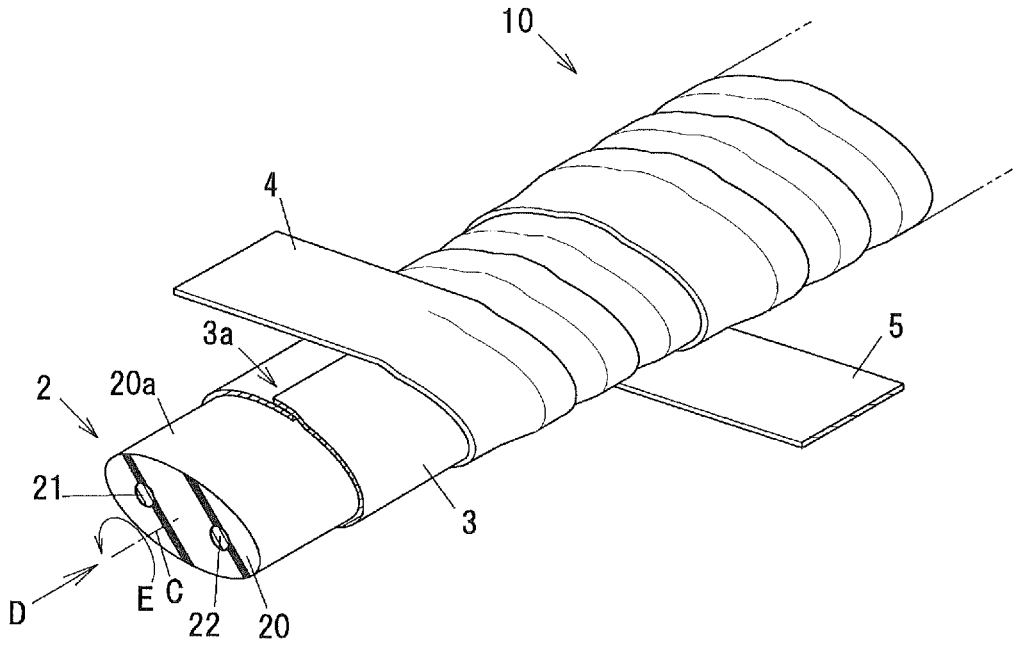
FIG. 4A is a perspective view showing the differential signal transmission cable in a production process.
Figure 4B:
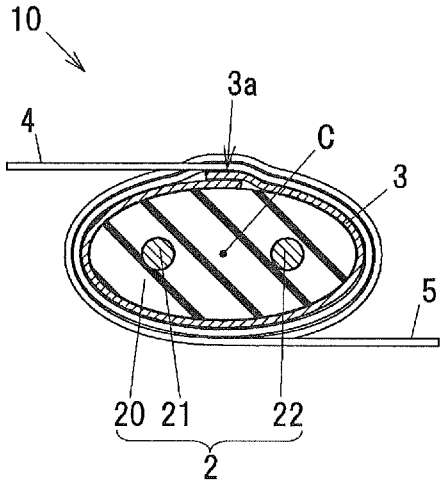
FIG. 4B is a fragmentary view taken in the direction of arrow D in FIG. 4A.

FIG. 4A is a perspective view showing the differential signal transmission cable 10 in a production process. FIG. 4B is a fragmentary view taken in the direction of arrow D in FIG. 4A.

The differential signal transmission cable 10 producing method includes the first step of longitudinally wrapping the shield tape conductor 3 around the outer side of the insulated wire 2 in such a manner that both its ends in the width direction are overlapped together; the second step of spirally winding the first resin tape 4 along the outer surface of the shield tape conductor 3 and around the outer side of the shield tape conductor 3; and the third step of spirally winding the second resin tape 5 along the outer surface of the first resin tape 4 and around the outer side of the first resin tape 4. In this embodiment, the longitudinal wrapping of the shield tape conductor 3, the spiral winding of the first resin tape 4 and the spiral winding of the second resin tape 5 are performed substantially concurrently. That is, the first to the third steps are performed substantially concurrently.

In the example shown in FIG. 4, the wrapping direction of the shield tape conductor 3, the winding direction of the first resin tape 4, and the widing direction of the second resin tape 5 viewed in the direction of arrow D are all the arrow E direction (counterclockwise). That is, in the first to the third steps, the circumferential winding directions around the center axis C of the insulated wire 2 of the shield tape conductor 3, the first and the second resin tapes 4 and 5 are the same direction.

Also, in the producing method in this embodiment, the first resin tape 4 to be wound around the outer side of the shield tape conductor 3, and the second resin tape 5 to be wound around the outer side of the first resin tape 4 are wound by applying tension thereto so that the first resin tape 4 and the second resin tape 5 are parallel to each other and in opposite directions to each other around the differential signal transmission cable 10.

Figure 5:
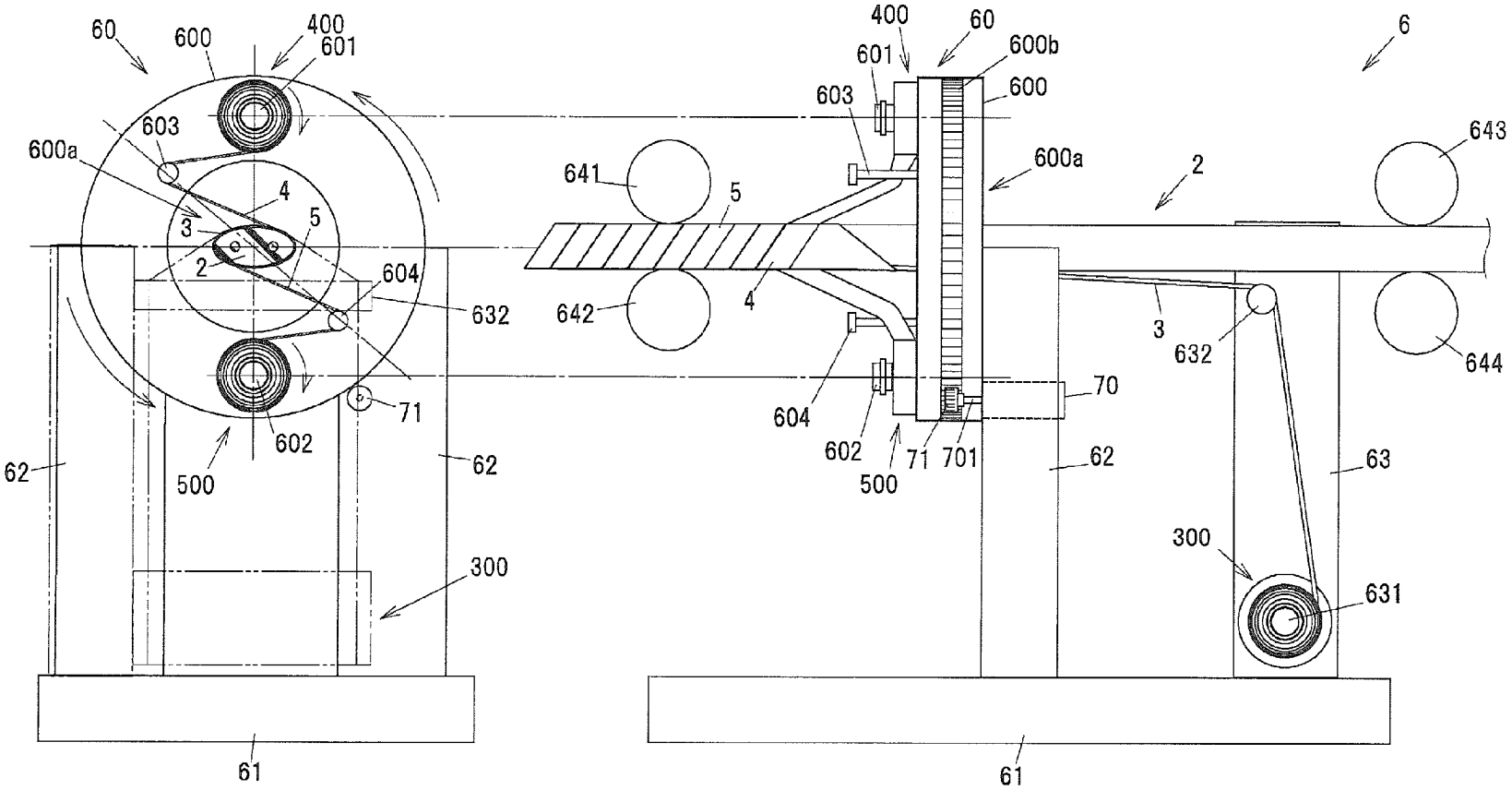
FIG. 5 is a schematic diagram showing a configuration example of a producing apparatus used in differential signal transmission cable production.
Figure 6:
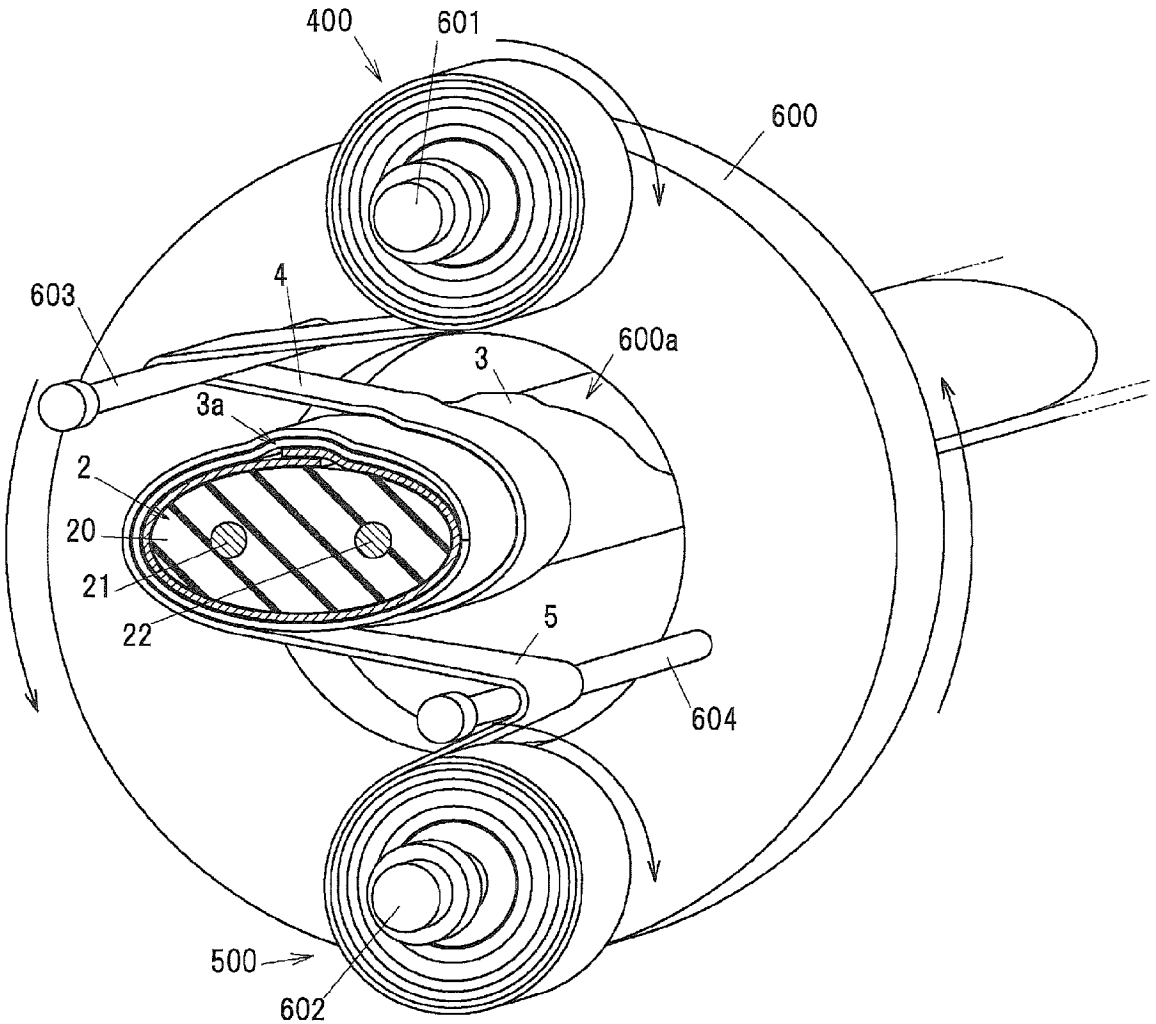
FIG. 6 is an enlarged perspective view showing an essential portion of FIG. 5.

FIG. 5 is a schematic diagram showing a configuration example of a producing apparatus 6 used in the production of the differential signal transmission cable 10. FIG. 6 is an enlarged perspective view showing an essential portion of FIG. 5.

The producing apparatus 6 comprises a base 61, a pair of pillars 62 and one reel supporting pillar 63 erected on the base 61. The pair of pillars 62 support a pivoting mechanism 60 which serves as a spirally winding means to spirally wrap the first resin tape 4 and the second resin tape 5 in the same direction.

The pivoting mechanism 60 includes a disc shaped ring member 600 pivotably supported to the pair of pillars 62 by a bearing not shown; first and second supporting portions 601 and 602 fixed to one plane of a pair of planes of the ring member 600; a first guiding member 603 for guiding the first resin tape 4; and a second guiding member 604 for guiding the second resin tape 5.

The first supporting portion 601 pivotably supports a reel 400 wound with the first resin tape 4, while the second supporting portion 602 pivotably supports a reel 500 wound with the second resin tape 5. The first resin tape 4 is drawn out from the reel 400, and guided by the first guiding member 603 to the outer side of the shield tape conductor 3. The second resin tape 5 is drawn out from the reel 500, and guided by the second guiding member 604 to the outer side of the first resin tape 4.

Also, the first supporting portion 601 is configured to apply a rotational resistive force to the reel 400, when the reel 400 rotates. Likewise, the second supporting portion 602 is configured to apply rotational resistive force to the reel 500, when the reel 500 rotates.

The first guiding member 603 and the second guiding member 604 are fixed to the plane to which the first and the second supporting portions 601 and 602 in the ring member 600 are fixed. The first guiding member 603 and the second guiding member 604 are fixed to the ring member 600 with the insulated wire 2 therebetween inserted in a through hole 600*a*. That is, the insulated wire 2 inserted in the through hole 600*a* is located between the first guiding member 603 and the second guiding member 604.

The through hole 600*a* for the insulated wire 2 to be inserted therein is formed in a central portion of the ring member 600. One pillar of the pair of pillars 62 supports a motor 70 for generating driving force to rotate the ring member 600. To a rotary shaft 701 of the motor 70 is relatively unrotatably fixed a pinion gear 71. The pinion gear 71 is configured to be meshed with gear teeth 600*b* formed in an outer surface of the ring member 600, so that the ring member 600 is rotated by rotation of the rotary shaft 701 of the motor 70. The motor 70, the pinion gear 71, and the gear teeth 600*b* of the ring member 600 constitute a rotary drive mechanism for rotating the ring member 600 around the insulated wire 2 together with the first and the second supporting portions 601 and 602 and the first and the second guiding members 603 and 604.

Also, the producing apparatus 6 includes first to fourth wheels 641 to 644 which serve as moving means for tensioning and moving the insulated wire 2 in a longitudinal direction of the insulated wire 2. The first and the second wheels 641 and 642 are disposed in such a manner as to face the plane provided with the first and the second supporting portions 601 and 602 of the ring member 600 thereon, and sandwich therebetween the insulated wire 2 wrapped with the shield tape conductor 3 and the first and the second resin tapes 4 and 5. The third and the fourth wheels 643 and 644 are disposed to face the opposite plane to the plane provided with the first and the second supporting portions 601 and 602 of the ring member 600, and sandwich the insulated wire 2 therebetween.

The first and the second wheels 641 and 642 are rotationally driven by a drive mechanism not shown, to draw the insulated wire 2 out from the through hole 600*a* and move the insulated wire 2. The third and the fourth wheels 643 and 644 are acted on by rotational resistive force of, for example a braking mechanism not shown, and are pivotably supported with that rotational resistive force acting thereon.

To the reel supporting pillar 63 is fixed a supporting portion 631 for pivotably supporting the reel 300 wound with the shield tape conductor 3. Also, above the supporting portion 631 of the reel supporting pillar 63, there is fixed a third guiding member 632 for guiding the shield tape conductor 3 drawn out from the reel 300 to the outer side of the insulated wire 2.

The shield tape conductor 3 is guided to the third guiding member 632, and is sandwiched between the outer surface 20*a* of the insulation 20 of the insulated wire 2 and the first resin tape 4 (the surface 40*a* of the resin layer 40), and is thereby longitudinally wrapped along the outer surface of the insulated wire 2. That is, in this embodiment, the pivoting mechanism 60 and the third guiding member 632 serve as a longitudinally wrapping mechanism for longitudinally wrapping the shield tape conductor 3 in the longitudinal direction of the insulated wire 2.

FIGS. 7A to 7D are time series schematic diagrams showing spirally wound states of first and second resin tapes by rotation of the ring member 600.

A reel 400 is acted on by rotational resistive force in rotation in the first supporting portion 601, so that when the first resin tape 4 is wrapped, the first resin tape 4 is acted on by tension T1 in its longitudinal direction. Also, a reel 500 is acted on by rotational resistive force in rotation in the second supporting portion 602, so that when the second resin tape 5 is wrapped, the second resin tape 5 is acted on by tension T2 in its longitudinal direction.

The insulation 20 of the insulated wire 2 is acted on by first pressing force P1 due to the tension T1 of the first resin tape 4. Also, the insulation 20 of the insulated wire 2 is acted on by second pressing force P2 due to the tension T2 of the second resin tape 5. As shown in FIGS. 7A to 7D, the first pressing force P1 and the second pressing force P2 act on the insulation 20 in such a manner that at least portions thereof face each other, and cancel each other.

Figure 7A:
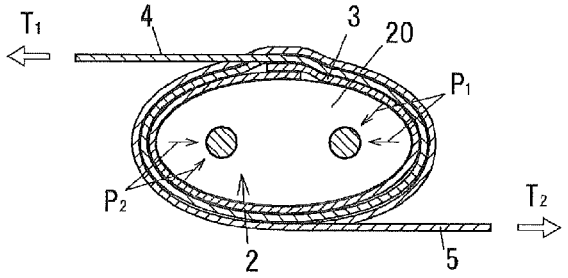
FIGS. 7A to 7D are time series schematic diagrams showing spirally wound states of first and second resin tapes by rotation of a ring member.
Figure 7B:
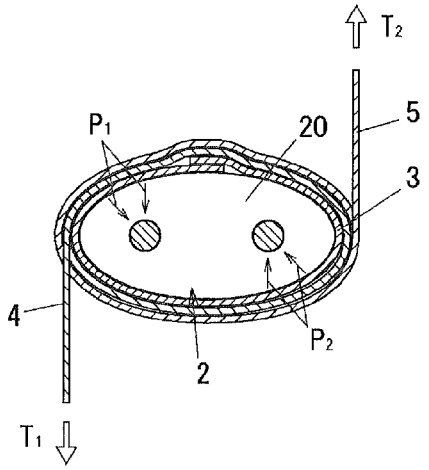
Figure 7C:
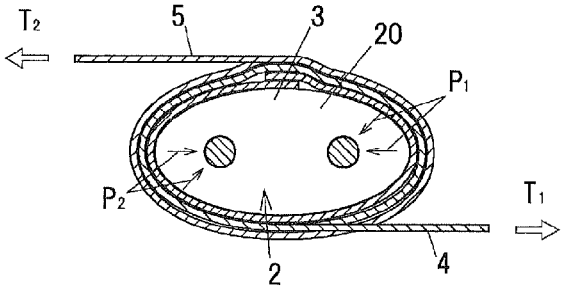
Figure 7D:
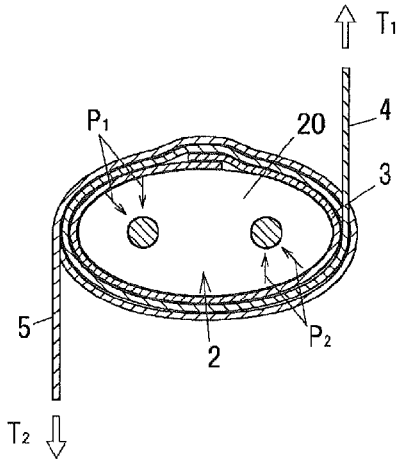

In other words, the displacement of the insulated wire 2 due to the tension T1 when the first resin tape 4 is spirally wound is always suppressed by the tension T2 when the second resin tape 5 is spirally wound. For example, in the state as shown in FIG. 7A, the insulated wire 2 is acted on by force so as to be displaced in the left direction in FIG. 7A due to the tension T1, while being acted on by force so as to be displaced in the right direction in FIG. 7A due to the tension T2. That is, since the displacement direction due to the tension T1 and the displacement direction due to the tension T2 are opposite each other, the displacement of the insulated wire 2 is suppressed. This relationship between the tension T1 and the tension T2 always holds during one rotation of the ring member 600 around the insulated wire 2 as shown in FIGS. 7B to 7D. This allows suppressing pivot of the insulated wire 2 (the insulated wire 2 pivoting along the ring track having predetermined spacing around the center axis of the through hole 600*a*) during production.

Comparative Example

Figure 8:
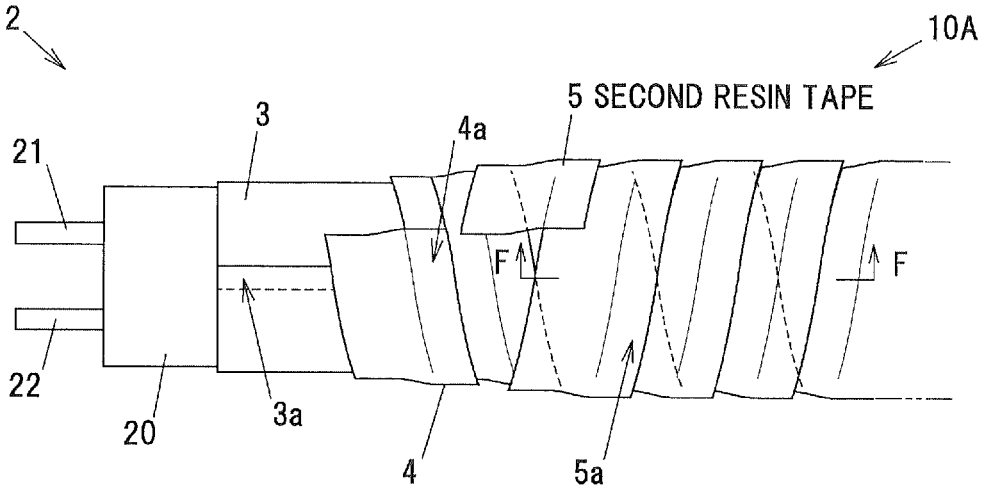
FIG. 8 is a side view showing a configuration of a differential signal transmission cable.
Figure 9:
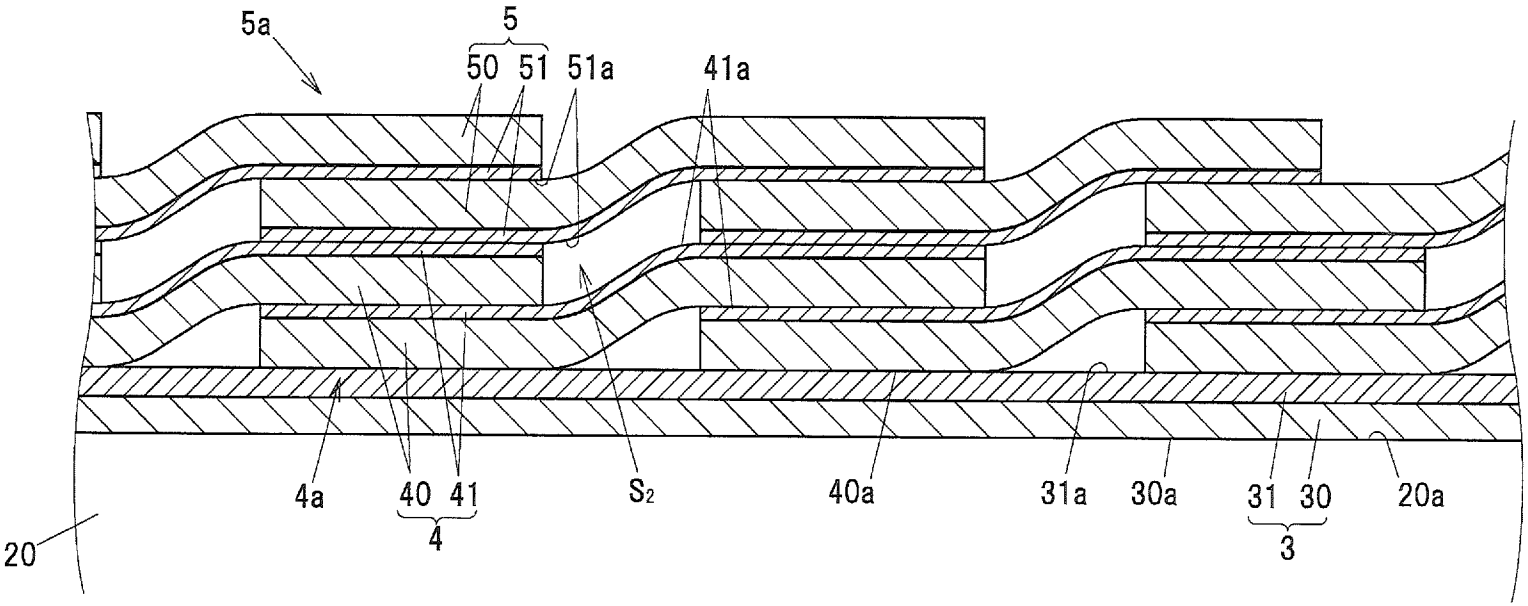
FIG. 9 is a partial cross-sectional view along line F-F in FIG. 8 showing the differential signal transmission cable.

Next, a differential signal transmission cable 10A is described as a comparative example, by reference to FIGS. 8 to 10. This differential signal transmission cable 10A is configured in the same manner as the differential signal transmission cable 10 in the above embodiment, except that the circumferential wrapping direction of the second resin tape 5 around the center axis C of the insulated wire 2 is the opposite direction to that of the first resin tape 4. In FIGS. 8 to 10, elements having similar functions to those described in the above embodiment are given the same reference numerals, and descriptions thereof are omitted.

FIG. 8 is a side view showing a configuration of the differential signal transmission cable 10A. In FIG. 8, an end in the width direction of the first resin tape 4 on the lower side (insulated wire 2 side) is indicated by a broken line. As shown in FIG. 8, the circumferential wrapping direction of the shield tape conductor 3 and the circumferential wrapping direction of the first resin tape 4 around the center axis C of the insulated wire 2 are the same direction. The first resin tape 4 and the second resin tape 5 are spirally wound by such cross wrapping that the circumferential winding directions thereof around the center axis C of the insulated wire 2 are opposite each other.

FIG. 9 is a partial cross-sectional view along line F-F in FIG. 8 showing the differential signal transmission cable 10A. Since the first resin tape 4 and the second resin tape 5 are cross wrapped as described above, there is created an area where the overlapped portions 4*a* of the first resin tape 4 and the overlapped portions 5*a* of the second resin tape 5 are overlapped together without misalignment in the normal direction to the outer surface 20*a* of the insulation 20. This creates a gap S2 larger than the gap S11 and S12 (see FIG. 3) in the differential signal transmission cable 10, between the two adjacent overlapped portions 4*a* and 5*a* in the center axis C direction of the insulated wire 2.

FIGS. 10A to 10D are time series schematic diagrams showing concurrently wound states of the first resin tape 4 and the second resin tape 5.

Figure 10A:
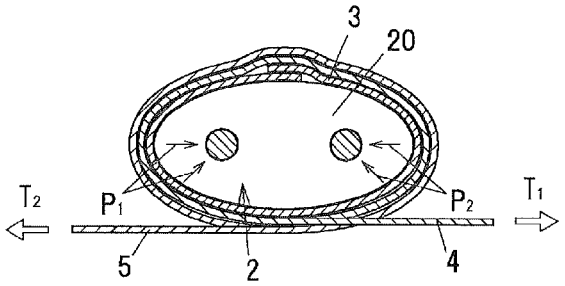
FIGS. 10A to 10D are time series schematic diagrams showing concurrently wrapped states of first and second resin tapes.
Figure 10B:
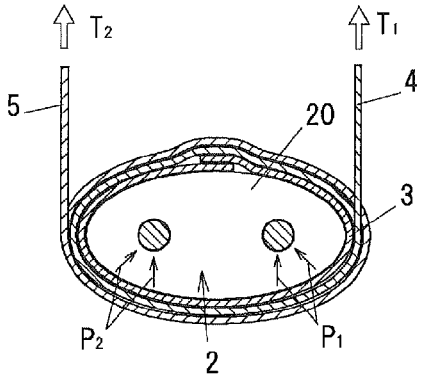
Figure 10C:
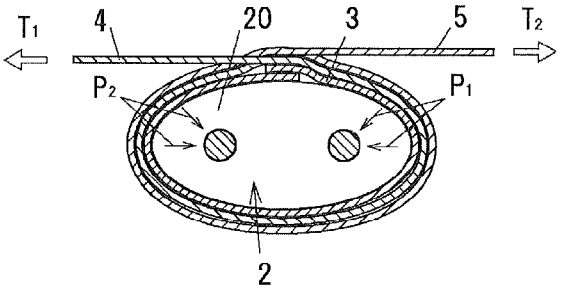
Figure 10D:
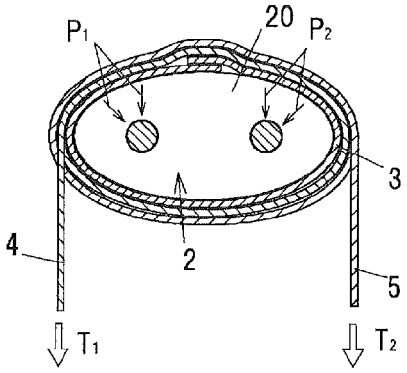

In the state as shown in FIG. 10B, the insulated wire 2 is acted on by the tension T1 and the tension T2 in a parallel and same direction (upward in FIG. 10B), so that the insulated wire 2 is displaced upward in FIG. 10B by the first and the second pressing forces P1 and P2. In contrast to FIG. 10B, in the state as shown in FIG. 10D, the insulated wire 2 is displaced downward in FIG. 10D by the tension T1 and the tension T2. That is, when the first resin tape 4 and the second resin tape 5 are concurrently cross wrapped, there exists a period for which the tension T1 of the first resin tape 4 and the tension T2 of the second resin tape 5 act on and displace the insulated wire 2 in the same direction. At this point, due to the insulated wire 2 being significantly bent, both the ends in the width direction of the shield tape conductor 3 in the overlapped portions 3*a* of the shield tape conductor 3 wrapped around the perimeter of the insulated wire 2 tend to be misaligned.

(Functions and Advantages of the Embodiment)

This embodiment has functions and advantages described below.

(1) The circumferential winding direction of the shield tape conductor 3 and the circumferential winding direction of the first resin tape 4 around the center axis C of the insulated wire 2 are the same. When spirally winding the first resin tape 4, it is therefore possible to suppress misalignment of both the ends in the width direction of the shield tape conductor 3 in the overlapped portions 3*a* of the shield tape conductor 3. That is, since in the overlapped portions 3*a* wrapping is performed from one upper end toward the other lower end, this one end is pressed against the other end, thereby allowing suppression of the occurrence of an air gap in the overlapped portions 3*a*. This allows suppression of signal skew in the first lead wire 21 and the second lead wire 22, and suppression of the occurrence of rapid signal attenuation in a high frequency band (e.g. 10 Gbps or higher).

(2) The circumferential wrapping direction of the first resin tape 4 and the circumferential wrapping direction of the second resin tape 5 around the center axis C of the insulated wire 2 are the same. For example, as shown in FIG. 7, when spirally winding the first resin tape 4 and the second resin tape 5, it is therefore possible to apply the tensions T1 and T2 to the insulated wire 2 so that the tensions T1 and T2 are always in mutually opposite directions, thereby allowing suppression of pivot of the insulated wire 2 when wrapped with the first resin tape 4 and the second resin tape 5. This allows suppression of the occurrence of an air gap resulting from misalignment of both the ends in the width direction of the shield tape conductor 3 in the overlapped portions 3*a* of the shield tape conductor 3, and can suppress signal skew or rapid signal attenuation.

(3) Since the first resin tape 4 and the second resin tape 5 are wound in such a manner that their respective adhesive layers 41 and 51 face each other, the first resin tape 4 and the second resin tape 5 are firmly joined together. This allows suppression of loosening of the shield tape conductor 3, thereby allowing suppression of signal skew.

(4) The overlapped portions 4*a* of the first resin tape 4 and the overlapped portions 5*a* of the second resin tape 5 are wrapped so as to be shifted in the center axis C direction of the insulated wire 2. For example, as shown in FIG. 3, this joins the ends of the first resin tape 4 on the respective upper sides of the two adjacent overlapped portions 4*a* along the center axis C of the insulated wire 2 to the second resin tape 5 on the lower side of one overlapped portion 5*a*, in B1 portion and B2 portion shown in FIG. 3. Also, the ends of the second resin tape 5 on the respective lower sides of the two adjacent overlapped portions 5*a* along the center axis C of the insulated wire 2 are joined to the first resin tape 4 on the upper side of one overlapped portion 4*a*, in B2 portion and B3 portion shown in FIG. 3. Also, the gaps S11 and S12 formed between the first resin tape 4 and the second resin tape 5 are small. Therefore, the first resin tape 4 and the second resin tape 5 are more firmly joined together.

(5) Since the insulation 20 has the convex outer edge in cross section perpendicular to the longitudinal direction of the insulated wire 2, the overlapped portions 3*a* of both the ends in the width direction of the shield tape conductor 3 are sandwiched between the insulation 20 and the first resin tape 4, and one end and the other end of the shield tape conductor 3 are pressed against each other. Therefore, both those ends are securely surface contacted and electrically connected together, and the occurrence of signal skew or rapid signal attenuation is securely suppressed.

(6) The first and the second supporting portions 601 and 602 and the first and the second guiding members 603 and 604 are fixed to the ring member 600. The integral rotation thereof allows the concurrent wrapping of the first resin tape 4 and the second resin tape 5. This allows efficient production of the differential signal transmission cable 10, for example, in comparison to when the wrapping of the first resin tape 4 over the entire length of the insulated conductor 2 is followed by the wrapping of the second resin tape 5.

(7) Since the first guiding member 603 and the second guiding member 604 are disposed to locate the insulated wire 2 therebetween, the displacement direction of the insulated wire 2 due to the tension T1 of the first resin tape 4 and the displacement direction of the insulated wire 2 due to the tension T2 of the second resin tape 5 are opposite each other, thereby suppressing pivot of the insulated wire 2.

(8) Since the second resin tape 5 is spirally wound in the same direction as the first resin tape 4 with the tension T1 acting thereon, the second resin tape 5 tends to be closely contacted with and along the uneven overlapped portions 4*a* of the first resin tape 4.

Although the embodiment of the invention has been described above, the embodiment described above should not be construed to limit the claimed invention. Also, it should be noted that not all the combinations of the features described in the above embodiment are essential to the means for solving the problems of the invention.

Also, the invention may be appropriately modified and practiced without departing from the spirit thereof. For example, although in the above described embodiment it has been described that the first lead wire 21 and the second lead wire 22 are together coated with the insulation 20, the insulation for coating the first lead wire 21 and the insulation for coating the second lead wire 22 are not limited thereto, but may separately be provided. Also, the number of differential signal transmission cables contained in the multiwire differential signal transmission cable 100 is not particularly restricted.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A differential signal transmission cable, comprising:

an insulated wire comprising a pair of differential signal transmission conductors coated with an insulation;

a shield tape conductor comprising a band-like member including an electrically conductive metal layer, the shield tape conductor being wrapped along an outer circumferential surface of the insulated wire so that ends in a width direction of the shield tape conductor are overlapped together;

a first resin tape free of metals, the first resin tape spirally wound along an outer circumferential surface of the shield tape conductor and in contact with and around an outer circumferential side of the shield tape conductor; and a second resin tape free of metals, the second resin tape being spirally wound along an outer circumferential surface of the first resin tape and around an outer circumferential side of the first resin tape, wherein the shield tape conductor, the first resin tape, and the second resin tape are wound in a same circumferential direction around a center axis of the insulated wire.

2. The differential signal transmission cable according to claim 1, further comprising:

adhesive layers provided around the outer circumferential side of the first resin tape and an inner side of the second resin tape respectively, wherein the first resin tape and the second resin tape are joined together by the adhesive layers.

3. The differential signal transmission cable according to claim 1, wherein the first resin tape is wrapped so that its portions in a width direction are overlapped together, and the second resin tape is wrapped so that its overlapped portions are shifted in a center axis direction of the insulated wire relative to the overlapped portions by wrapping of the first resin tape.

4. The differential signal transmission cable according to claim 1, wherein the pair of differential signal transmission conductors in the insulated wire are together coated with the insulation, and the insulation comprises a convex and continuous outer shape in a cross section perpendicular to a longitudinal direction of the insulated wire.

5. A multiwire differential signal transmission cable, comprising:

a plurality of differential signal transmission cables each comprising the differential signal transmission cable according to claim 1, the plurality of the differential signal transmission cables being shielded together.

6. A differential signal transmission cable producing apparatus for producing the differential signal transmission cable according to claim 1, the differential signal transmission cable producing apparatus comprising:

means for tensioning and moving the insulated wire in a longitudinal direction of the insulated wire;

means for longitudinally wrapping the shield tape conductor in the longitudinal direction of the insulated wire; and means for spirally winding the first resin tape and the second resin tape in the same circumferential direction, wherein the spirally winding means includes:

a ring member provided with a through hole in a central portion for the insulated wire to be inserted therein;

a first supporting portion for supporting a first reel wound with the first resin tape;

a second supporting portion for pivotably supporting a second reel wound with the second resin tape; and a rotary drive mechanism for rotating the ring member around the insulated wire together with the first supporting portion and the second supporting portion.

7. The differential signal transmission cable producing apparatus according to claim 6, wherein the spirally winding means further includes:

a first guiding member for guiding the first resin tape to an outer circumferential side of the shield tape conductor; and a second guiding member for guiding the second resin tape to the outer circumferential side of the first resin tape, wherein the first guiding member and the second guiding member are fixed to locate the insulated wire therebetween.

8. The differential signal transmission cable according to claim 1, wherein the first resin tape contacts with opposite sides of the outer circumferential surface of the shield tape conductor, the opposite sides of the outer surface of the shield tape conductor being disposed opposite to each other with respect to the pair of differential signal transmission conductors.

9. The differential signal transmission cable according to claim 1, wherein the first resin tape abuts an entirety of the outer circumferential surface of the shield tape conductor.

10. The differential signal transmission cable according to claim 1, further comprising:

a tubular inclusion layer encircling an outer circumferential surface of the second resin tape.

11. The differential signal transmission cable according to claim 10, further comprising:

a shield conductor encircling an outer circumferential surface of the tubular inclusion layer.

12. The differential signal transmission cable according to claim 11, further comprising:

a braided wire contacting and covering an outer circumferential surface of the shield conductor.

13. The differential signal transmission cable according to claim 12, further comprising:

an insulation jacket contacting and covering an outer circumferential surface of the braided wire.

14. The multiwire differential signal transmission cable according to claim 5, further comprising:

a tubular inclusion layer encircling outer circumferential surfaces of the second resin tapes of a first set of the differential signal transmission cables; and a shield conductor encircling an outer circumferential surface of the tubular inclusion layer.

15. The multiwire differential signal transmission cable according to claim 14, wherein a second set of the differential signal transmission cables is disposed between the tubular inclusion layer and the shield conductor.

16. The multiwire differential signal transmission cable according to claim 15, further comprising:

a braided wire contacting and covering an outer circumferential surface of the shield conductor.

17. The multiwire differential signal transmission cable according to claim 16, further comprising:

an insulation jacket contacting and covering an outer circumferential surface of the braided wire.

18. A differential signal transmission cable producing method, comprising:

wrapping a shield tape conductor made of a band-like member including an electrically conductive metal layer around an outer circumferential side of an insulated wire comprising a pair of differential signal transmission conductors coated with an insulation, in such a manner that both ends in a width direction of the shield tape conductor are overlapped together;

spirally winding a first resin tape free of metals along an outer circumferential surface of the shield tape conductor and in contact with and around an outer circumferential side of the shield tape conductor; and spirally winding a second resin tape free of metals along an outer circumferential surface of the first resin tape and around an outer circumferential side of the first resin tape, wherein circumferential winding directions around a center axis of the insulated wire of the shield tape conductor, the first resin tape, and the second resin tape are the same.

19. The differential signal transmission cable producing method according to claim 18, wherein the first resin tape and the second resin tape are spirally wound in such a manner that a displacement of the insulated wire due to a tension when the first resin tape is spirally wound is always suppressed by a tension when the second resin tape is spirally wound.

20. The differential signal transmission cable producing method according to claim 18, wherein the first resin tape and the second resin tape are spirally wound by inserting the insulated wire in a through hole provided in a ring member, guiding the first resin tape and the second resin tape with first and second guiding portions respectively fixed to the ring member, and rotating the ring member, and wherein the first and second guiding portions are fixed to locate the insulated wire therebetween.

* * * * *